US010905967B1

(12) United States Patent
Satok-Wolman

(10) Patent No.: US 10,905,967 B1
(45) Date of Patent: Feb. 2, 2021

(54) COMPONENT BASED SYSTEM FOR ASSEMBLING GEOMETRIC STRUCTURES

(71) Applicant: Ezra Joseph Satok-Wolman, Caledon (CA)

(72) Inventor: Ezra Joseph Satok-Wolman, Caledon (CA)

( * ) Notice: Subject to any disclaimer, the term of this patent is extended or adjusted under 35 U.S.C. 154(b) by 0 days.

(21) Appl. No.: 15/696,915

(22) Filed: Sep. 6, 2017

Related U.S. Application Data

(60) Provisional application No. 62/384,289, filed on Sep. 7, 2016.

(51) Int. Cl.
*A63H 33/08* (2006.01)
*A63H 33/10* (2006.01)

(52) U.S. Cl.
CPC ..... *A63H 33/08* (2013.01); *A63H 33/103* (2013.01)

(58) Field of Classification Search
CPC ..... A63H 33/08; A63H 33/108
See application file for complete search history.

(56) References Cited

U.S. PATENT DOCUMENTS 1,492,342 A 4/1924 Weiner
1,678,239 A 7/1928 Bayardi et al.
1,778,726 A 10/1930 Pappert
1,851,159 A 3/1932 Dodge
1,853,367 A * 4/1932 Mace ..... E04H 15/48 135/123
1,997,723 A 4/1935 Franklin, Jr.
2,018,539 A * 10/1935 Welsh ..... E04G 7/24 403/218
2,426,326 A * 8/1947 Tooms ..... A63H 33/108 29/451
2,506,396 A 5/1950 Swanson
2,667,739 A 2/1954 Flaig
2,765,580 A * 10/1956 Herrschaft ..... A63H 33/102 403/167
2,778,207 A 1/1957 Thaler
2,833,113 A 5/1958 Dolansky
2,882,616 A 4/1959 Benjamin
2,962,820 A 12/1960 Petersen
(Continued)

FOREIGN PATENT DOCUMENTS

GB 19141633 A * 7/1914

*Primary Examiner* — Melba Bumgarner
*Assistant Examiner* — Amir A Klayman
(74) *Attorney, Agent, or Firm* — Malloy & Malloy, PL; Peter Matos

(57) ABSTRACT

An assembly structured to form a customizable, variably configured geometric structure, which includes a plurality of hubs each having an interior chamber and a plurality of housings. Each housing includes an open ended interior channel communicating with the interior chamber of a common hub. A plurality of elastic links are each retained within and extend outwardly from a different one of said interior channels, wherein at least one elastic link of each hub is retained within a housing and connected to one other of said plurality of hubs. A predetermined number of the plurality of hubs may be disposed in interconnected relation to one another to define a closed, continuously configured array of hubs. A plurality of the closed, continuously configured array of hubs may be disposed in interconnected relation to one another to define one of a possible plurality of the customizable, variably configured geometric structures.

9 Claims, 4 Drawing Sheets

(56) References Cited

U.S. PATENT DOCUMENTS 3,049,897 A 8/1962 Arpels
3,077,750 A 2/1963 Gibeault
3,080,662 A 3/1963 Brumlik
3,176,428 A * 4/1965 Slingluff ..... A63H 33/108 446/107
3,234,903 A 2/1966 Vara, Sr.
3,333,349 A 8/1967 Brumlik
3,355,820 A 12/1967 Brumlik
D211,905 S * 8/1968 Goodridge ..... D25/68
3,433,032 A 3/1969 Dennen
3,509,642 A 5/1970 Brumlik
3,554,584 A 1/1971 Brumlik
3,580,438 A 5/1971 Raval
3,587,226 A 6/1971 Rieth
3,670,524 A 6/1972 Korwin
3,690,334 A * 9/1972 Boyd ..... A01M 31/025 135/123
3,694,954 A 10/1972 Brumlik
3,704,541 A 12/1972 Kennedy
3,830,011 A 8/1974 Ochrymowich
3,898,777 A * 8/1975 Georgiev ..... E04B 1/3211 52/81.1
3,901,045 A 8/1975 Ballester
3,918,196 A * 11/1975 Schleich ..... A63H 33/04 446/107
3,970,301 A * 7/1976 Lehmann ..... A63B 9/00 482/35
4,020,566 A 5/1977 Dreiding
4,030,209 A 6/1977 Dreiding
4,078,328 A * 3/1978 Rayment ..... A63H 33/108 446/102
4,080,925 A 3/1978 Moore
4,234,263 A 11/1980 Robinson et al.
4,262,461 A 4/1981 Johnson et al.
4,274,222 A * 6/1981 Zahn ..... A63H 33/102 124/5
4,326,354 A * 4/1982 Hagberg ..... A63H 33/108 446/126
4,362,031 A 12/1982 Obermuller
4,458,478 A 7/1984 North
4,480,418 A 11/1984 Ventrella
D278,834 S 5/1985 Satoh
4,614,502 A * 9/1986 Nelson ..... A63F 9/0876 135/121
4,714,370 A * 12/1987 Chen ..... A47B 47/0008 403/171
4,733,544 A 3/1988 Londaro
4,778,184 A * 10/1988 Fleischer ..... A63F 9/088 273/155
4,864,795 A * 9/1989 Burg ..... F16B 7/04 52/646
4,979,276 A 12/1990 Chimento
5,030,103 A 7/1991 Buist et al.
5,129,279 A 7/1992 Rennex
5,395,279 A * 3/1995 McCann ..... A63F 9/088 446/487
5,412,956 A 5/1995 Levy
5,417,085 A 5/1995 Regev
5,433,549 A 7/1995 McGaffigan
5,556,219 A 9/1996 Mason
5,567,046 A 10/1996 Lucas
5,626,434 A 5/1997 Cook
5,797,695 A 8/1998 Prusmack
6,478,649 B1 * 11/2002 Hoback ..... A63H 33/06 446/126
6,513,346 B1 2/2003 Giovanni
6,571,578 B2 6/2003 Akyol
6,679,644 B1 * 1/2004 Heller ..... A63H 33/10 135/127
6,748,962 B2 * 6/2004 Miller ..... E04B 1/3211 135/120.3
6,869,246 B2 * 3/2005 Bridgers ..... F16B 7/048 135/122
6,892,744 B2 * 5/2005 Feldpausch ..... E04H 15/001 135/114
7,261,444 B2 8/2007 Bayer et al.
7,357,004 B2 4/2008 Winston
7,419,325 B2 9/2008 Rantrua
7,454,924 B2 11/2008 Grad
8,192,105 B2 * 6/2012 Keyvanloo ..... A47B 47/0016 403/171
8,257,088 B1 * 9/2012 Askins ..... G09B 19/003 434/247
RE44,696 E 1/2014 Saarela et al.
2002/0151248 A1 * 10/2002 Hsu ..... A63H 33/108 446/126
2004/0011079 A1 1/2004 Rose
2004/0103688 A1 6/2004 Flaviano
2004/0158999 A1 8/2004 Trantow
2006/0162380 A1 7/2006 Czajka et al.
2008/0168760 A1 7/2008 Cazzola
2009/0056373 A1 3/2009 Czajka et al.
2010/0300010 A1 12/2010 Vallejo
2013/0180283 A1 7/2013 Camurati et al.
2013/0219961 A1 8/2013 Silver et al.
2014/0000313 A1 1/2014 Barbazza
2014/0227025 A1 8/2014 Giveans
2014/0265114 A1 9/2014 Laniewicz
2014/0318101 A1 10/2014 Cazzola
2014/0370478 A1 12/2014 Pfeiffer
2015/0052944 A1 2/2015 Affolter
2015/0104992 A1 * 4/2015 Jung ..... A63H 33/108 446/91
2015/0132734 A1 5/2015 Dye et al.
2015/0289610 A1 10/2015 Dholakiya
2015/0321111 A1 * 11/2015 Samlaska ..... A63H 23/005 446/124
2015/0335108 A1 11/2015 Chiarini

* cited by examiner

COMPONENT BASED SYSTEM FOR ASSEMBLING GEOMETRIC STRUCTURES

CLAIM OF PRIORITY

The present application is based on and a claim of priority is made under 35 U.S.C. Section 119(e) to a provisional patent application that is currently pending in the U.S. Patent and Trademark Office, namely, that having Ser. No. 62/384,289 and a filing date of Sep. 7, 2016, and which is incorporated herein by reference.

BACKGROUND OF THE INVENTION

Field of the Invention

The present invention is directed to an assembly structured to form any one of a possible plurality of customizable, variably configured, flexible, geometric structures through the interconnection of a plurality of component hubs to one another into a closed, continuously configured array of hubs. A plurality of the closed, continuously configured array of hubs may be interconnected to define a selected one of the possible plurality of the customizable variably configured geometric structures.

Description of the Related Art

Different fields of art include products, devices, materials, etc. which are intended to be variably structured to form a variety of differently configured and dimensioned objects. Such different fields of art include, but are not limited to, jewelry, sculpture, fashion, industrial design, architecture, structural engineering, nano-engineering, aerospace and the medical field.

By way of example only, jewelry pieces have a tendency to be rigid and thereby are not well adapted to conform to various body portions of the wearer, wherein such jewelry pieces may include bracelets, necklaces, etc. Such rigidity or lack of adaptability may result in discomfort to the wearer as well as an increase in the possibility of damage to or breakage of the jewelry pieces.

In order to overcome problems and disadvantages of the type set forth above, not only in the jewelry art but in other fields of endeavor as well there is a need for a component-based assembly and/or system for the making of different flexible geometric structures, wherein such preferred and proposed geometric structures may be formed into any one of a possible plurality of customizable, variably configured structures. As such, a proposed and preferred assembly and/or system of this type would facilitate the production and/or formation of different products, devices, goods, etc. in different fields of art which could assume a predetermined or preferred configuration while being sufficiently flexible and/or resilient to conform or adapt, in shape or size, to any other object, device, structure, etc., with which it is intended to be used.

Moreover, a preferred and proposed assembly and/or system could incorporate the use of a plurality of hub components each cooperatively structured with the other to be interconnected to one another, individually or in interconnected arrays, by means of elastic flexible links. The use of such interconnecting, elastic and flexible links, in combination with the cooperatively structured plurality of hubs, would significantly enhance versatility of a resulting geometric structure by allowing a variance in the size, shape, flexibility, elasticity, adaptability, etc., of the end product.

SUMMARY OF THE INVENTION

The present invention is directed to an assembly and/or system structured to form any one of a possible plurality of customizable, variably configured geometric structures capable of defining a variety of different objects, devices and/or goods such as, but not limited to, jewelry pieces or other different fields of art. The customizable, variably configured geometric structure comprises a plurality of interconnected hub components cooperatively structured with and interconnected by a plurality of elastic links.

More specifically, at least one but more practically a plurality of the hub components or "hubs" each include an interior chamber and a plurality of housings. The housings may vary in number and extend radially outward from the base or body of a common hub. As such, the hub is at least partially defined by the corresponding plurality of housings each having their proximal ends fixedly interconnected to one another in adjacent and/or contiguous relation.

Further, each of the housings include an interior channel which includes oppositely disposed open ends. An open inner end of each of the plurality of interior channels of the housings of a common hub are disposed in direct communicating relation with the interior chamber thereof. As described in greater detail hereinafter, a connector structure may be disposed on each of the plurality of hubs, at least partially within the interior chamber.

In addition, a plurality of elastic links are associated with each of the plurality of hubs and for a given hub, are equal in number to the number of housings associated with that hub. Further, each of the plurality of elastic links includes opposite ends and are disposed and retained within a different one of the interior channels of the housings associated with a given hub. Also, each of the elastic links may be dimensioned and configured to have one of the opposite ends disposed at least partially within the interior chamber of an associated hub. As such, each of the elastic links extend along the length of a corresponding interior channel and outwardly from an outer open end thereof. Accordingly, each of the opposite ends of each elastic link may include an attachment member cooperatively dimensioned, configured and structured with the aforementioned connector structure. The correspondingly positioned one of the attachment members is disposed within the interior chamber of the corresponding hub. The cooperative structuring between the attachment members of each of the elastic links and that of the connector structure facilitates a retaining connection of each of the elastic links into respective ones of the interior channels.

Additional structural and operative features of one or more preferred embodiments of the assembly of the present invention may also include a removable disposition of the connector structure within the interior chamber. Therefore, each of the corresponding elastic links connected to the removable connector structure may be defined as being "removably retained" within individual ones of the interior channels. This removable retention further facilitates the structure and cooperative use of the plurality of hubs as well as their interconnection to one another, as set forth in greater detail hereinafter. Also, the provision of attachment members on or integrated with each of the opposite ends of each of the plurality of elastic links allows either end of the elastic links to be disposed in a retained relation within any of the interior channels of any of the plurality of housings of any of the plurality of cooperatively structured hubs.

The plurality of elastic links may be utilized in the form of generally elongated spring members such as, but not limited to, a coil spring. Regardless of their specific form, the elastic links/spring members are structured to be both elastic and flexible and include an inherent bias. Such inherent bias facilitates the tendency of the elastic link/spring member to return from an elastically expanded or flexibly deformed orientation, when force or tension is applied thereto, back into an original or initial orientation, when the applied force or tension is reduced or removed. Such inherent bias will further facilitate an enhanced versatility of the assembly and the adaptability of the resulting or formed geometric structure to conform to different shapes, sizes, etc. of a device, object, etc. with which the geometric structure is used.

As will also be explained in greater detail hereinafter, a predetermined number of the plurality of hubs may be disposed in interconnected relation to one another to define a closed, continuously configured array of hubs. The size and configuration of each of such array of hubs may vary dependent on the number of hubs being interconnected to form and/or define a given interconnected array of hubs. In addition, a plurality of the closed, continuously configured array of hubs may be disposed in interconnected relation to one another to define one of a possible plurality of the customizable, variably configured geometric structures.

It will be further noted that the versatile structural and operational features of each of the plurality of hubs and each of the plurality of elastic links significantly facilitate the interconnection of the plurality of hubs to one another to form the closed, continuously configured array of hubs. Similarly, the plurality of elastic links are used to define the interconnection of the plurality of hub arrays to one another, to form any one of a possible plurality of customizable, variably configured geometric structures.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
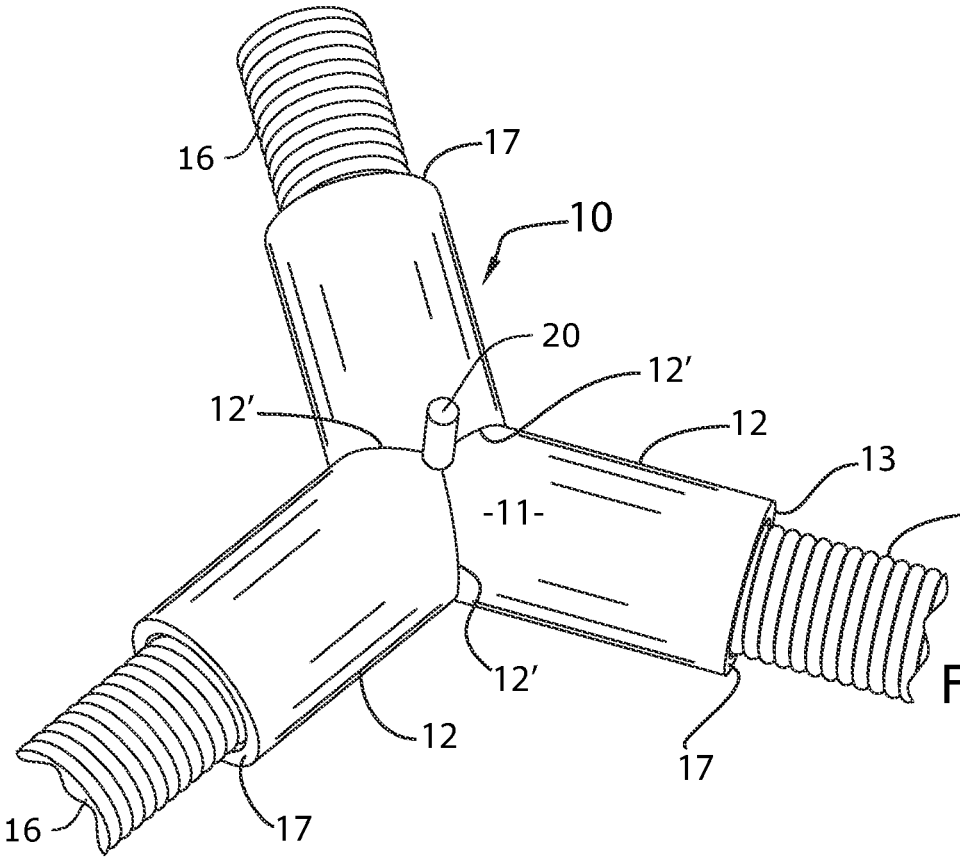
FIG. 1 is a perspective detailed view of one preferred embodiment of a hub component of the assembly of the present invention.

As represented in the accompanying Figures, the present invention is directed to an assembly and/or system structured to form any one of a possible plurality of customizable, variably configured geometric structures 200 capable of defining a variety of different objects, devices and/or goods such as, but not limited to, jewelry pieces or other different fields of art. The customizable, variably configured geometric structure 200 comprises a plurality of interconnected hub components 10 cooperatively structured with and interconnected by a plurality of elastic links 16.

More specifically, at least one but more practically a plurality or majority of the hub components or "hubs" 10 each include an interior chamber 40 and a plurality of housings 12. The housings 12 may vary in number and extend radially outward from the base or body 11 of a common hub in spaced relation to one another. As such, the hub 10 is at least partially defined by the corresponding plurality of housings 12 each having their open proximal ends 17 fixedly interconnected to one another in adjacent and/or contiguous relation.

Further, each of the housings 12 include an open interior channel 15 which includes oppositely disposed open ends 17 and 17'. An open inner end 17' of each of the plurality of interior channels 15 of the housings 12 of a common hub 10 are disposed in direct communicating relation with the interior chamber 40 thereof. As described in greater detail hereinafter, a connector structure 20 may be disposed on each of the plurality of hubs, at least partially within the interior chamber 40. More specifically, the connector structure 20 may be removably inserted into the interior chamber 40 by passing through an access opening or aperture 14.

Figure 7:
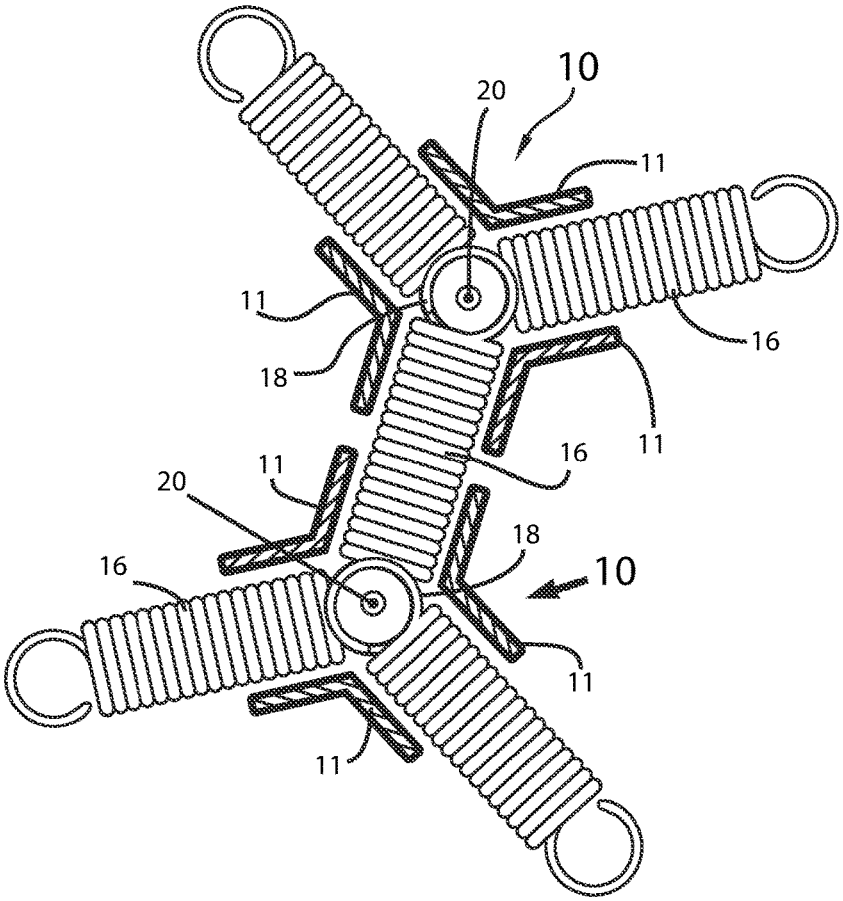
FIG. 7 is a section view of a plurality of hub components in accordance with one embodiment of the present invention.

In addition, the plurality of elastic links 16 are associated with each of the plurality of hubs 10 and for a given hub 10, are equal in number to the number of housings 12 associated with that hub 10. Further, each of the plurality of elastic links 16 includes opposite ends 16'. Further, each of the elastic links 16 is disposed and retained within a different one of the interior channels 15 of the housings 12 associated with a given hub 10. Also, each of the elastic links 16 may be dimensioned and configured to have one of the opposite ends 16' disposed at least partially within the interior chamber 40 of an associated hub 10. As such, each of the elastic links 16 extends along the length of a corresponding interior channel 15 and outwardly from an outer open end thereof 17. In addition, each of the opposite ends 16' of each elastic links 16 may include an attachment member 18 cooperatively dimensioned, configured and structured with the aforementioned connector structure 20. Moreover, each of the attachment members 18 are preferably integrated in and thereby define a corresponding end 16' of the respective elastic links 16. The correspondingly positioned one of the attachment members 18 is disposed within the interior chamber 40 of the corresponding hub 10. The cooperative structuring between the attachment members 18 of each elastic links 16 and that of the connector structure 20 facilitates a retaining connection of each elastic links 16 into respective ones of the interior channels 40. Further, as represented throughout the figures, each of the attachment members 18 attached to each opposite end 16' of the elastic links 16 may be structured to include or at least partially define a hook or loop like configuration. Such hook or loop like configuration is cooperatively dimensioned and configured with the connector structure 20 so as to at least partially surround the connector structure 20 as represented throughout the Figures. Such a configuration is depicted throughout the Figures, and specifically in FIG. 7, showing a section view of two hubs 10 adjoined with a common elastic link, via connector structures 20 disposed through each attachment member 18 of the common elastic link 16.

Additional structural and operative features of one or more preferred embodiments of the assembly of the present invention may also include a removable disposition of the connector structure 20 within the interior chamber 40, such as by being removably disposed within the access opening or aperture 14. Therefore, each of the corresponding elastic links 16 connected to the removable connector structure 20 may be defined as being "removably retained" within individual ones of the interior channels 15. This removable retention further facilitates the structure and cooperative use of the plurality of hubs 10 as well as their interconnection to one another, as set forth in greater detail hereinafter. Also, the provision of attachment members 18 on or integrated with each of the opposite ends 16' of each of the plurality of elastic links 16 allows either end 16' and corresponding ones of the attachment members 18 of the elastic links 16 to be disposed in a retained relation within any of the interior channels 15 of any of the plurality of housings 12 of any of the plurality of cooperatively structured hubs 10.

Figure 2:
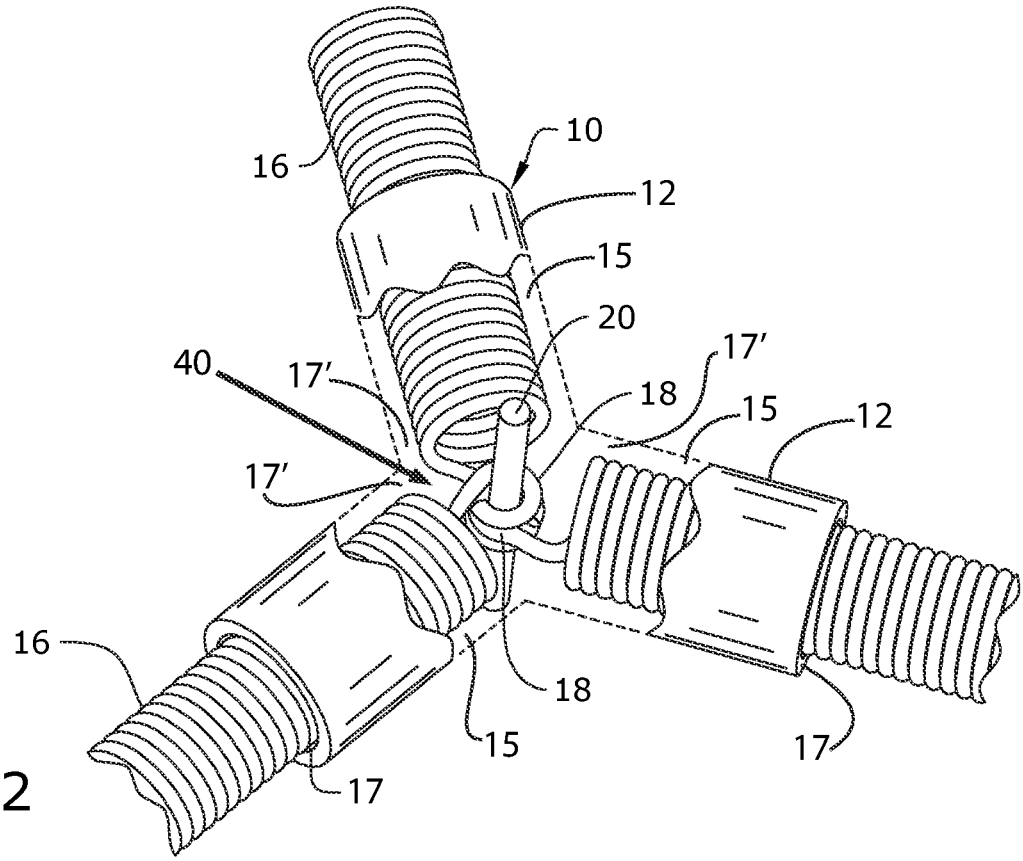
FIG. 2 is a perspective view in partial cutaway of the embodiment of FIG. 1.
Figure 3:
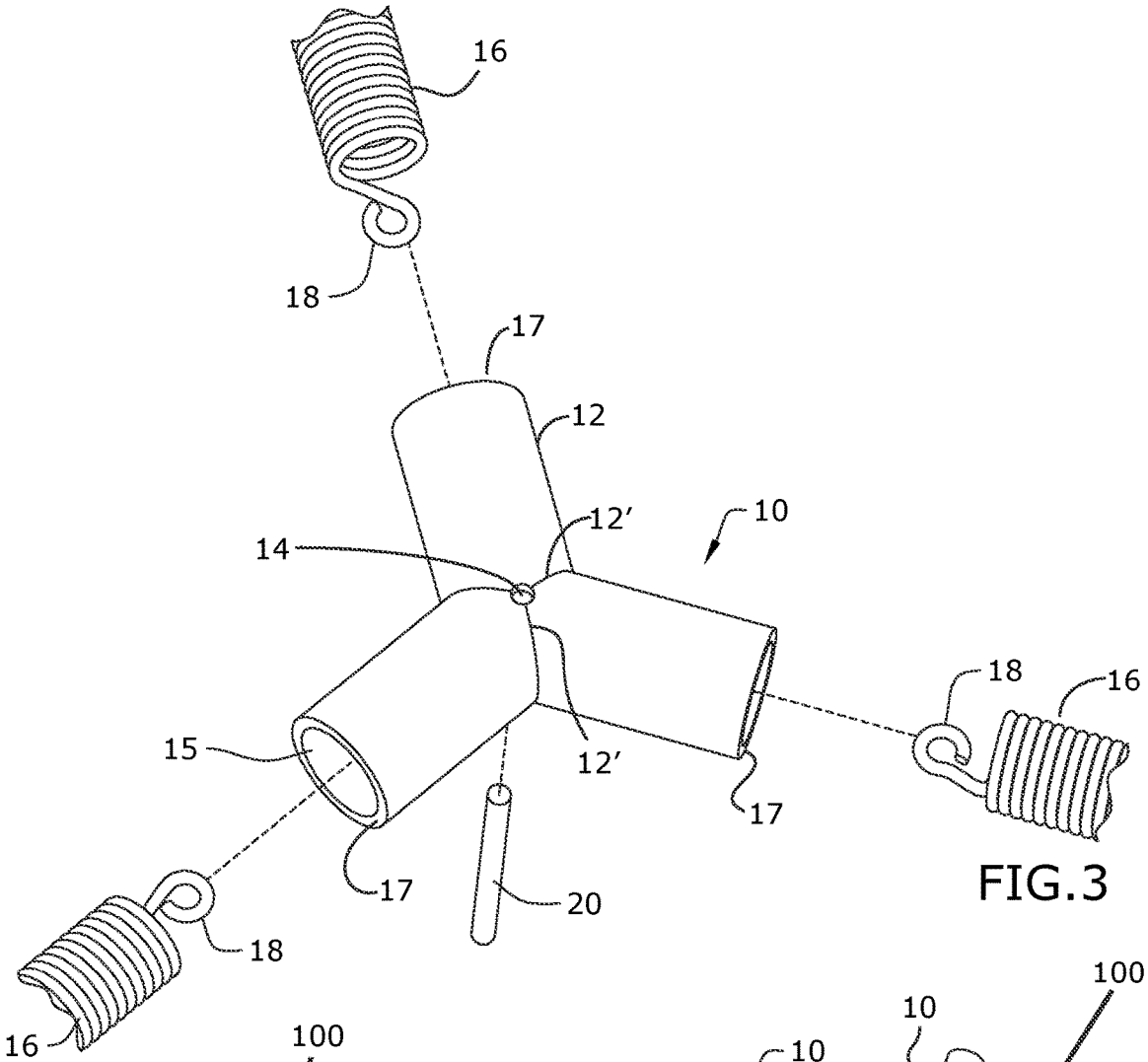
FIG. 3 is a perspective view in exploded form of the embodiment of the hub component as represented in FIGS. 1 and 2.

The plurality of elastic links 16 may be utilized in the form of generally elongated spring members such as, but not limited to, coil springs. Regardless of their specific form, the elastic links/spring members 16 are structured to be both elastic and flexible and include an inherent bias. Such inherent bias facilitates the tendency of the elastic link/spring member 16 to return from an elastically expanded or flexibly deformed orientation, when force or tension is applied thereto, back into an original or initial orientation, when the applied force or tension is reduced or removed. Such an original or initial orientation is represented in both FIGS. 1 and 2. Further, the inherent bias of the elastic links 16 will facilitate an enhanced versatility of the assembly and the adaptability of the resulting or formed geometric structure 200 to conform to different shapes, sizes, etc. of a device, object, etc. with which the geometric structure 200 is used.

Figure 4:
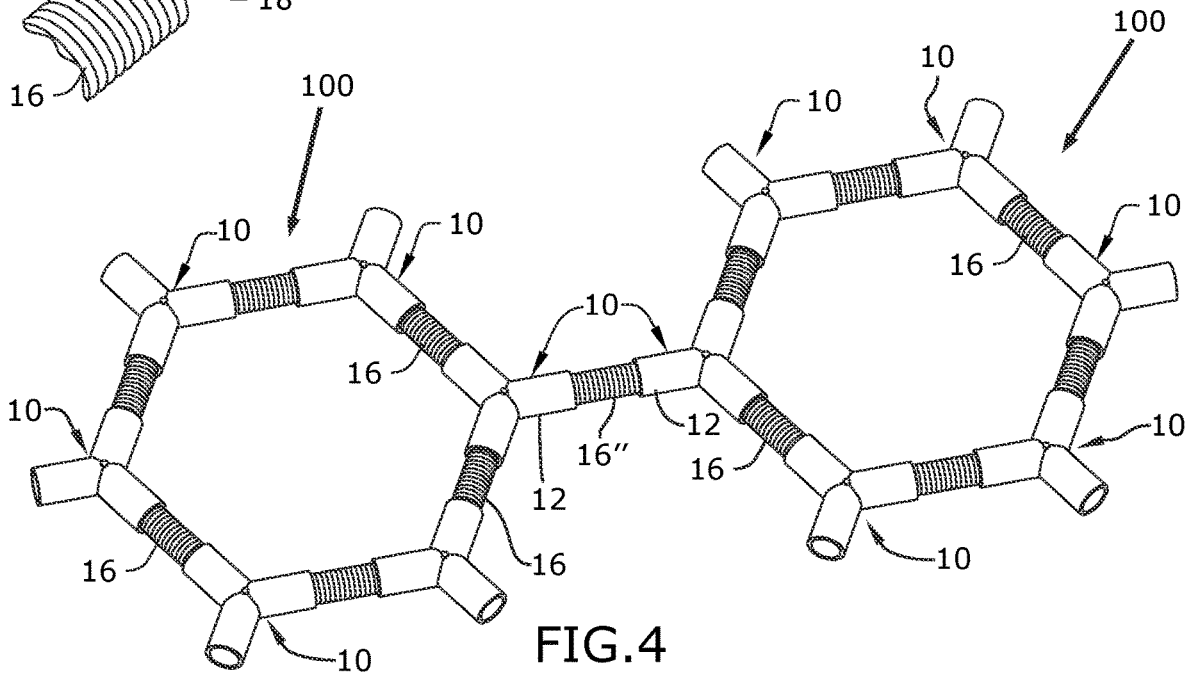
FIG. 4 is a perspective view of a plurality of hub components connected to one another to define one or more closed, continuous arrays of hubs.

As will also be explained in greater detail hereinafter, a predetermined number of the plurality of hubs 10 may be disposed in interconnected relation to one another to define a closed, continuously configured array 100 of hubs 10 as clearly represented in FIG. 4. The size and configuration of each of such array of hubs 10 may vary dependent on the number of hubs 10 being interconnected to form and/or define a given interconnected array 100 of hubs 10. More specifically, each of the hub arrays 100 represented in FIG. 4 include six interconnected hubs 10, thereby defining a hub array 100 having six sides. However, other closed continuous arrays of hubs 100 may include a different, predetermined number of hubs 10 being interconnected to one another in a closed, continuously configured array 100. By way of example only, if four hubs 10 were interconnected to one another in a closed, continuously configured array, the number of sides of such an array would be four in number. Similarly, and further by way of example, if three of the hubs 10 were interconnected to one another in a closed, continuously configured array, the number of sides of the closed, continuously configured array would be three in number. Accordingly, the predetermined number of hubs 10 in each of the closed, continuously configured array's 100 is determinative of one of a possible plurality of configurations of said closed, continuously configured array 100.

Figure 5:
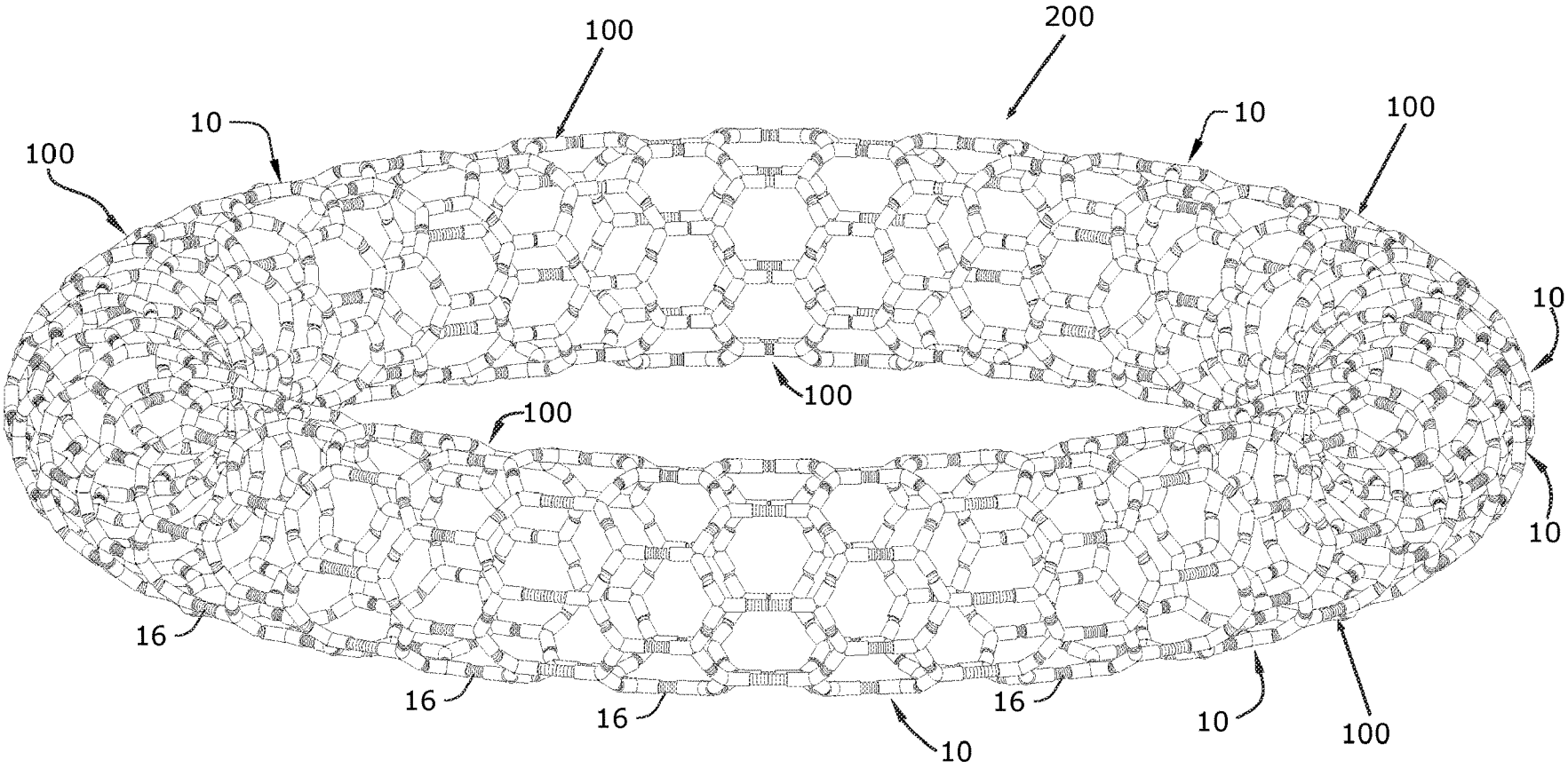
FIG. 5 is a perspective view of a flexible, multi-hub component geometric structure comprised of a plurality of closed, continuously configured array of hubs, disposed in interconnected relation to one another.

In addition and as represented in FIG. 5, a plurality of the closed, continuously configured arrays 100 of hubs 10 may be disposed in interconnected relation to one another to define one of a possible plurality of the customizable, variably configured geometric structures 200. As represented, the geometric structure includes an overall annular, circular, torus, toroidal, etc. configuration made up of the plurality of interconnected arrays 100 of hubs 10. However, it is emphasized that the substantially annular configuration of the geometric structure 200 of FIG. 5 is representative only of a larger number of possible configurations of the geometric structure 200 which may or may not be "continuous" or "closed". Further by way of example, the geometric structure 200 of FIG. 5 may be representative of a piece of jewelry such as a bracelet, necklace, etc. It is again emphasized that the assembly of the present invention may be used to form customizable, variably configured geometric structures 200 having various shapes, sizes, etc.

It will be further noted that the versatile structural and operational features of each of the plurality of hubs 10 and each of the plurality of elastic links 16 significantly facilitate the interconnection of the plurality of hubs 10 to one another to form the closed, continuously configured array 100 of hubs 10. Similarly, the plurality of elastic links 16 are used to define the interconnection of the plurality of hubs 10 of each hub array 100. Further, one or more of the elastic links, as denoted at 16" in FIG. 4 are used to interconnect different ones of the hub arrays 100 to one another, to form any one of a possible plurality of customizable, variably configured geometric structures 200.

Therefore and as represented throughout the Figures, at least one of the elastic links 16 connected to one of the hubs 10 of a given hub array 100 may also be connected to one other of the plurality of hubs 10 which may be independent of but more practically associated with a different one of the hub arrays 100. Also, the configuration of each of the hub arrays 100 may be the same or may differ from one another in the formation of the customizable, variably configured geometric structure 200.

Figure 6A:
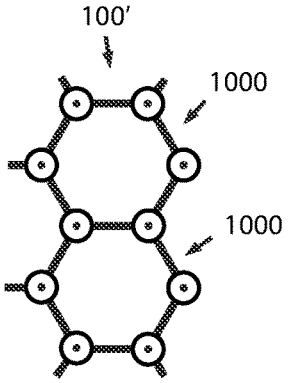
FIG. 6A is a schematic depiction of a plurality of closed, continuous arrays of hubs disposed in a hexagonal arrangement, according to one embodiment of the present invention.
Figure 6B:
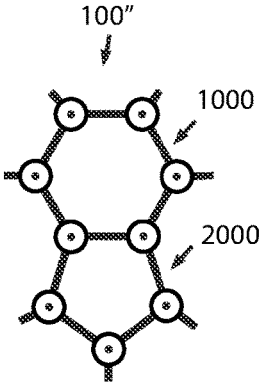
FIG. 6B is a schematic depiction of a plurality of closed, continuous arrays of hubs disposed in a hexagonal and pentagonal arrangement, according to another embodiment of the present invention.
Figure 6C:
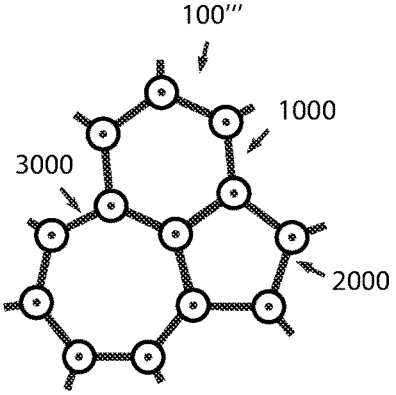
FIG. 6C is a schematic depiction of a plurality of closed, continuous arrays of hubs disposed in a hexagonal, pentagonal, and heptagonal arrangement, according to another embodiment of the present invention.

Now turning to FIGS. 6A, 6B, and 6C, schematic depictions of hub arrays 100', 100", and 100'" according to various embodiments of the present invention can be seen. Specifically, FIG. 6A depicts an embodiment wherein the hub array 100' includes at least two hexagonal arrangements 1000; FIG. 6B depicts an embodiment wherein the hub array 100" includes at least one hexagonal arrangement 1000 and one pentagonal arrangement 2000; FIG. 6C depicts an embodiment wherein the hub array 100'" includes at least one hexagonal arrangement, one pentagonal arrangement, and one heptagonal arrangement. Further variations and combinations may be achieved, as desired, due to the flexibility of the elastic links 16 which are capable of accommodating a wide variety of internal and external connection angles, regardless of the precise shape or configuration of the hub 10. In this regard, the elastic links 16 are adaptable to a user's desire or necessity and provides for the assembly complex geometric structures, such as a buckminsterfullerene, which requires both hexagons and pentagons that share hubs 10 or hub arrays 1000. With regard to the depicted embodiments throughout the Figures, the hubs 10 include a 120 degree connection angle, though virtually any angle may be utilized, but if a different connection angle is desired, such as 108 degrees, used in forming a pentagon, the elastic links 16 accommodate such an angle.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An assembly structured to assume a customizable, variably-configured geometric structure, said assembly comprising:

a plurality of elastically interconnected hubs disposed in an initial orientation, each one of said plurality of hubs including an interior chamber and a plurality of housings, said plurality of housings fixedly interconnected at correspondingly disposed proximal ends thereof, each one of said plurality of housings including an interior channel having open inner and outer ends, thereby establishing a plurality of interior channels within each one of said plurality of hubs, and for each one of said plurality of hubs, each of said plurality of interior channels being concurrently disposed in communicating relation with said interior chamber;

each of said plurality of hubs further including an aperture disposed therethrough in communicating relation with said interior chamber;

a plurality of elastic links each disposed in a different one of said interior channels, each of said elastic links including opposite ends terminating in a loop configuration;

each of said loop configurations disposed within said interior chamber;

a single connector structure disposed through said aperture into retaining relation with each of said plurality of loop configurations; and each of said elastic links further including an inherent bias for the return of said plurality of hubs from an elastically expanded orientation to said initial orientation.

2. The assembly as recited in claim 1 wherein each of said elastic links is dimensioned to extend from said interior chamber along a length of a respective one of said interior channels and out of said open outer end thereof.

3. The assembly as recited in claim 2 wherein said one opposite end of each of said elastic links is disposed within said interior chamber in retained relation to said hub.

4. The assembly as recited in claim 1 wherein said interior chamber and said fixedly connected proximal ends are substantially centrally disposed on said at least one hub.

5. The assembly as recited in claim 1 further comprising a single connector structure disposed within said interior chamber; said one opposite end of each of said elastic links attached in retaining relation to said single connector structure, within said interior chamber.

6. The assembly as recited in claim 1 wherein said plurality of housings extend radially outward from a central portion of said at least one hub in spaced relation to one another.

7. The assembly as recited in claim 6 wherein said plurality of housings are disposed on said at least one hub in substantially equally spaced relation to one another.

8. The assembly as recited in claim 7 wherein said plurality of housings are three in number and disposed in a spaced relation of about 120° from one another.

9. The assembly as recited in claim 1 wherein each of said elastic links includes a flexible spring member variably deformable and inherently biased into an original orientation.

* * * * *